US007591377B2

(12) United States Patent
Puda et al.

(10) Patent No.: US 7,591,377 B2
(45) Date of Patent: Sep. 22, 2009

(54) METHOD AND APPARATUS FOR A VIBRATING SCREEN AGGREGATE SEPARATOR

(76) Inventors: James John Puda, 42553 N. 260th Ave., Morristown, AZ (US) 85342; Scott Alan Boster, 831 N. Grace St., Scottsdale, AZ (US) 85257

( * ) Notice: Subject to any disclaimer, the term of this patent is extended or adjusted under 35 U.S.C. 154(b) by 126 days.

(21) Appl. No.: 11/563,010

(22) Filed: Nov. 23, 2006

(65) Prior Publication Data

US 2007/0158244 A1 Jul. 12, 2007

Related U.S. Application Data

(60) Provisional application No. 60/757,606, filed on Jan. 10, 2006.

(51) Int. Cl.
*B07B 1/08* (2006.01)
*B07B 1/44* (2006.01)
*B07B 1/42* (2006.01)

(52) U.S. Cl. ..... 209/358; 209/309; 209/367; 209/369

(58) Field of Classification Search ..... 209/358, 209/364, 365.1, 365.3–365.5, 367, 369, 405; 384/419; 74/87
See application file for complete search history.

(56) References Cited

U.S. PATENT DOCUMENTS 1,920,972 A * 8/1933 Deister ..... 209/326
2,684,754 A * 7/1954 Bankauf et al. ..... 198/609
2,961,277 A * 11/1960 Sternlicht ..... 384/99
3,693,793 A * 9/1972 Hahn ..... 209/326
4,197,194 A * 4/1980 Read ..... 209/325
4,237,000 A * 12/1980 Read et al. ..... 209/319
4,262,549 A * 4/1981 Schwellenbach ..... 74/87
5,482,165 A * 1/1996 Johnston ..... 209/244
5,494,173 A * 2/1996 Deister et al. ..... 209/326
5,641,071 A * 6/1997 Read et al. ..... 209/319
6,029,822 A * 2/2000 Skoropa ..... 209/326
6,669,026 B2 * 12/2003 Cohen et al. ..... 209/366.5

* cited by examiner

*Primary Examiner*—Patrick H Mackey
*Assistant Examiner*—Mark Hageman
(74) *Attorney, Agent, or Firm*—Michael T. Wallace

(57) ABSTRACT

A vibrating screen aggregate separation device separates finer grained material from an aggregate material that may contain a wide variety of undesired materials. A mesh design associated with a vibrating screen contains perforations to allow smaller diameter material to pass through into a container that is situated below the screen. A suspension system is affixed between the container and the vibrating screen to allow a range of motion that is conducive to vibration of the screen, while at the same time, is supportive of the weight of the aggregate material that is to be screened. Vibration of the screen is effected by rotating an unbalanced rod along its longitudinal axis to induce vibrational energy to the screen and associated supporting structures.

20 Claims, 13 Drawing Sheets

METHOD AND APPARATUS FOR A VIBRATING SCREEN AGGREGATE SEPARATOR

This application claims the benefit of U.S. Provisional Application No. 60/757,606, filed Jan. 10, 2006, the contents of which are incorporated herein by reference in their entirety.

FIELD OF THE INVENTION

The present invention generally relates to aggregate separators, and more particularly to a mobile, vibrating screen apparatus that is used to separate granular materials.

BACKGROUND

Since excavation of materials from the earth's surface, or subjacent to the earth's surface, has been occurring, the need to refine the excavated material has existed. In particular, the excavated material is often comprised of various compositions, such as rock, sand, pebbles, mineral deposits, and other contaminants or otherwise undesirable compositions. In such instances, the desired material, e.g., sand and pebbles of reduced diameter, are often required to be separated from larger diameter contaminants that may be contained within the excavated material.

Depending upon the application, separation of the larger diameter contaminants from the desired material may be accomplished through the use of a number of various aggregate separation devices. Vibratory feeders, for example, utilize conveyor belts that are configured to: accept raw material input at one end of the conveyor belt; transport the raw material to the other end of the conveyor belt; vibrate the conveyor belt during transport to mechanically expel unwanted material; and deposit the refined material at the opposite end of the conveyor belt. Other conveyor based feeders may utilize electromagnetic means to separate ferrous materials from nonferrous materials.

Due to the sheer size and weight of these prior art aggregate separators, however, transportability becomes an almost prohibitive constraint to their use at job sites whose locations are constantly changing. Fixed location quarries, on the other hand, may utilize these prior art aggregate separators effectively, since once the prior art aggregate separators are installed at the quarry, transportability is no longer an issue.

Other job sites requiring excavation and back filling operations, such as construction job sites, however, pose transportability issues in regard to prior art aggregate separators. For example, the size and weight of conveyor based aggregate separators nearly preclude their transport via towable trailers, especially to construction sites having limited access. In addition, should the conveyor based aggregate separators find their way to a particular construction job site, their mere presence may hinder other construction activities that may be occurring at the job site, simply due to the amount of area required to operate the conveyor based aggregate separators.

Efforts continue, therefore, to improve the methods and apparatus that may be used for aggregate separation. In particular, advancements are desired to develop aggregate separators that are more conducive to transportability. In addition, once at the job site, such a transportable aggregate separation device must occupy as little space as possible, so as to avoid disruption of other activities that may be occurring.

SUMMARY

To overcome limitations in the prior art, and to overcome other limitations that will become apparent upon reading and understanding the present specification, various embodiments of the present invention disclose an apparatus and method of using a highly mobile, vibrating screen aggregate separator to separate finer grained materials from more coarsely grained materials.

In accordance with one embodiment of the invention, an aggregate separation device comprises a container, a suspension system that is coupled to the container, and a screen that is coupled to the suspension system. The screen is configured with a plurality of perforations having a first diameter. The aggregate separation device further comprises a hollow shaft that is coupled to the screen, an unbalanced rod displaced within the hollow shaft, a mechanical energy source that is coupled to the unbalanced rod and is adapted to rotate the unbalanced rod to transfer vibrational energy to the screen via the hollow shaft. The aggregate separation device further comprises a support bearing that is coupled along a length of the unbalanced rod to prevent excessive deflection of the unbalanced rod during rotation.

In accordance with another embodiment of the invention, a method of separating desired material from an aggregate material comprises placing a quantity of aggregate material onto a screen, the screen being configured with a plurality of perforations having a first diameter. The method further comprising displacing an unbalanced rod within a hollow shaft, rotating the unbalanced rod within the hollow shaft to transfer vibrational energy to the screen, supporting the unbalanced rod at a midpoint along a length of the unbalanced rod to eliminate excessive deflections of the unbalanced rod during rotation and filtering desired material from the aggregate material through the screen in response to the vibrational energy transfer. The desired material being composed of granules having a diameter less than the first diameter.

In accordance with another embodiment of the invention, an aggregate separation device comprises a container having first and second openings, a suspension system that is coupled to the container, a screen that is coupled to the suspension system and displaced over the first opening. The screen is configured with a plurality of perforations having a first diameter. The aggregate separation device further comprises a hollow shaft that is coupled to the screen, the hollow shaft including an unbalanced rod displaced within the hollow shaft. The aggregate separation device further comprises a mechanical energy source that is coupled to the unbalanced rod and is adapted to rotate the unbalanced rod to vibrate the screen. The aggregate material that is placed on the screen is filtered into granules having a diameter less than the first diameter by the vibrating screen and the granules are accessible within the container via the second opening.

BRIEF DESCRIPTION OF THE DRAWINGS

Various aspects and advantages of the invention will become apparent upon review of the following detailed description and upon reference to the drawings in which.

DETAILED DESCRIPTION

Figure 1A:
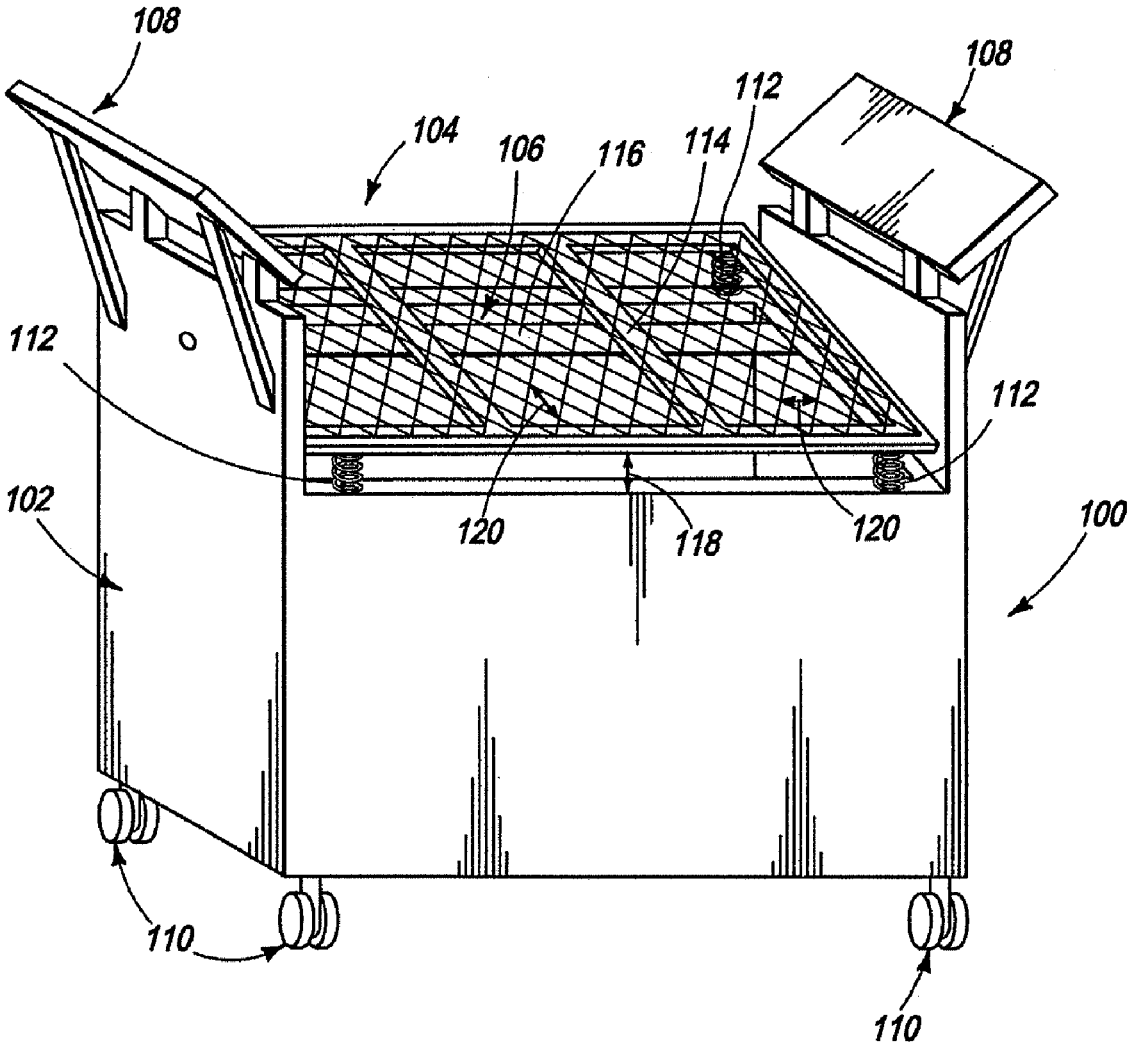
FIG. 1A illustrates a front view of an exemplary vibrating screen aggregate separator.

Generally, the various embodiments of the present invention are applied to a vibrating screen aggregate separation device that may be used to separate granular material. In particular, a mesh design associated with the screen, such as a sieve, contains perforations to allow smaller diameter material, i.e., the desired material, to pass through into a container that is situated below the screen. The screen may be angled so that once the pre-screened material is placed on top of the screen, the larger diameter material, i.e., the undesired material, may simply roll off of the screen to be safely separated away from the desired material that is stored within the container.

Guiding panels may be attached to the container and situated above the screen, to allow pre-screened material to be placed on the screen with a minimum of spillage. Such may be the case, for example, when the bucket width of a front loader, bucket loader, or other material moving device, is wider than the vibrating screen. In such instances, once the bucket is maneuvered to drop material onto the vibrating screen, material from each end of the bucket may be collected by each guiding panel and directed to the vibrating screen for subsequent separation.

A suspension system may be affixed between the container and the vibrating screen to allow a range of motion that is conducive to vibration of the screen, while at the same time, is supportive of the weight of the pre-screened material. That is to say, in other words, that the screen is maintained at a separation distance from the container, so as to allow full scale deflection of the screen during all vibration cycles while simultaneously preventing contact between the screen and the container.

Thus, so long as the weight of the pre-screened material is maintained within the weight constraints of the suspension system, full scale deflections may be imparted to the screen in an oscillatory fashion, so as to cause a vibrating movement of the screen. During screen vibration, aggregate is separated into one of two material types: 1) oversized material that rolls off the screen with a trajectory defined by the pitch orientation of the screen to form a pile of undesired material; or 2) appropriately sized material that passes through the mesh of the screen into the container to form a pile of desired material. The maximum size of each grain of the desired material may be selected by appropriately adjusting the diameter of the mesh perforations of the screen to be equal to the maximum grain size that is required in the desired material.

Oscillatory deflections may be imparted to the screen via rotation of an unbalanced rod along its longitudinal axis within a hollow shaft that may be coupled to the screen. An unbalance is formed in the rod by creating a mass at each end of the rod that is greater than the rod's mass at its center. As the rod is rotated along its longitudinal axis, the angular momentum at each end of the rod is greater than the angular momentum at the center of the rod due to the increased mass at each end of the unbalanced rod. Thus, the moment of inertia generated at each end of the rod is greater than the moment of inertia at the rod's center. The difference in moments of inertia imparts an oscillation to the screen, whose fundamental frequency is inversely proportional to the amount of time required to rotate the unbalanced rod through a 360 degree cycle.

The unbalanced rod may be housed within a hollow shaft, the hollow shaft being rigidly coupled to the screen and associated supporting structures. At each end of the hollow shaft, supporting structures, such as pillow block bearings, may be attached. The unbalanced rod may then be secured to each pillow block bearing to provide load support during the unbalanced rod's rotation along its longitudinal axis.

In order to add further stability to the unbalanced rod during rotation, a third supporting structure may be added. In particular, while the unbalanced rod is secured at each end by, for example, pillow block bearings, an additional pillow block bearing may be added at, or near, the center point of the unbalanced rod. As such, positioning of the unbalanced rod through all rotation cycles may be controlled so as to avoid excessive deflections of the unbalanced rod that are orthogonal to its longitudinal axis.

Such deflections may be caused, for example, by the elasticity of the material used for the unbalanced rod, whereby excessive forces imposed on the unbalanced rod cause it to bend, or strain, under stress. In other embodiments, the necessity of a center-mounted support structure for the unbalanced rod may be obviated by increasing the rigidity of the unbalanced rod, thereby decreasing its elasticity. Such increases in rigidity may be accomplished, for example, through selection of more rigid materials, or conversely, through a design of the unbalanced rod that is resistant to stress induced deformation.

The unbalanced rod's rotation may be effected by applying a rotational force at either end of the rod. In one embodiment, a pulley, or gear, may be attached to one end of the rod, which may then be coupled to a mechanical energy source, such as an electrical motor or combustion engine. The motor or engine, having its own rotating shaft and pulley, or gear, may then impart rotational energy to the unbalanced rod via a belt or chain. In particular, the pulley that is attached to the motor may be non-rigidly coupled, via a belt or chain, to the pulley that is attached to the unbalanced rod. As such, the motor's shaft may rotate substantially vibration free, while at the same time imparting rotational energy to the unbalanced rod, which in turn imparts oscillatory deflections to the unbalanced rod that are orthogonal to its longitudinal axis of rotation.

As the unbalanced rod oscillates, vibrational energy is transferred to the screen, whereby variations in the tension of the belt or chain may also occur. However, due to the non-rigidity of the belt or chain that couples each pulley, oscillatory deflections of the unbalanced rod do not cause damage to the motor, since any potentially damaging deflections are largely absorbed by the interaction of the belt or chain with each pulley.

Turning to FIG. 1A, a front view of exemplary vibrating screen aggregate separator 100 is illustrated. As can be seen, support structure 104 may be coupled to screen 106 via various support members of support structure 104. Each support member may include vertical support members 114 and/or other support members (not shown) to provide support at other angles with respect to screen 106.

Guiding panels 108 may be attached to container 102 and situated above screen 106 as illustrated, to allow pre-screened material to be placed onto screen 106 with a minimum of spillage. Such may be the case, for example, if the bucket width of a front loader, bucket loader, or other material moving device, is wider than the width of screen 106. In such instances, once the bucket is maneuvered to drop material onto screen 106, material from each end of the bucket may be collected by each guiding panel 108 and directed to screen 106 for subsequent separation.

In particular, it can be seen that each guiding panel 108 extends outward from two sides of container 102. Each guiding panel 108 is additionally angled downward, toward screen 106 and support structure 104, such that once pre-screened material is deposited onto guiding panels 108, the pre-screened material may slide onto screen 106 via gravitational and/or vibrational forces that are active during operation of vibrating screen aggregate separator 100.

As discussed in more detail below, suspension system 112, may be coupled between container 102 and screen 106 to allow a range of motion that is conducive to vibration of screen 106, while at the same time, is supportive of the weight of the pre-screened material that is deposited onto screen 106. That is to say, in other words, that screen 106 is maintained at a separation distance 118 from container 102, so as to allow full scale deflection of screen 106 and supporting structure 104 during all vibration cycles, while simultaneously preventing contact between screen 106/supporting structure 104 and container 102.

Thus, so long as the weight of the pre-screened material is maintained within the design constraints of suspension system 112, full scale deflections may be imparted to screen 106 in an oscillatory fashion, so as to cause a vibrating movement of screen 106. As discussed in more detail below, for example, suspension system 112 may include a plurality of coiled springs having a plurality of spring constants k1, k2, . . . , kn, and associated range of physical dimensions. Each of the plurality of springs may then interact with one another to produce a variable compression force that is adaptive to the position of screen 106 and support structure 104 relative to container 102.

For example, once the initial load of pre-screened material is deposited onto screen 106 and support structure 104, the amount of compression force that is exerted by suspension system 112 is maximized by the mechanical engagement of individual springs within suspension system 112 that have higher spring constants. As the pre-screened material begins to either drop into container 102, or is rejected by screen 106, the amount of compression force that is exerted by suspension system 112 reduces due to the decreasing weight of the pre-screened material. As such, during the course of aggregate separation of a single load of material, distance 118 is maintained within a range of distance, such that support structure 104 and screen 106 is precluded from making contact with container 102.

During the vibrating movement of screen 106, which is induced by shaft 116, the oversized material either rolls off screen 106 with a trajectory defined by the pitch orientation of screen 106, or the desired material passes through the mesh of screen 106 into container 102. The maximum size of each grain of the desired material may be selected by appropriately adjusting the diameter of mesh perforations 120 of screen 106 to be equal to the maximum grain size that is required in the desired material.

Mobility of vibrating screen aggregate separator 100 is exemplified in at least 2 respects. First, a conveyor system is not required, which allows vibrating screen aggregate separator 100 to be easily transported to a job site via virtually any truck and/or towable trailer. Second, once at the job site, optional casters 110 allow maneuvering of vibrating screen aggregate separator 100 to a location within the job site that is unobtrusive to the other activities that may be occurring at the job site.

Figure 1B:
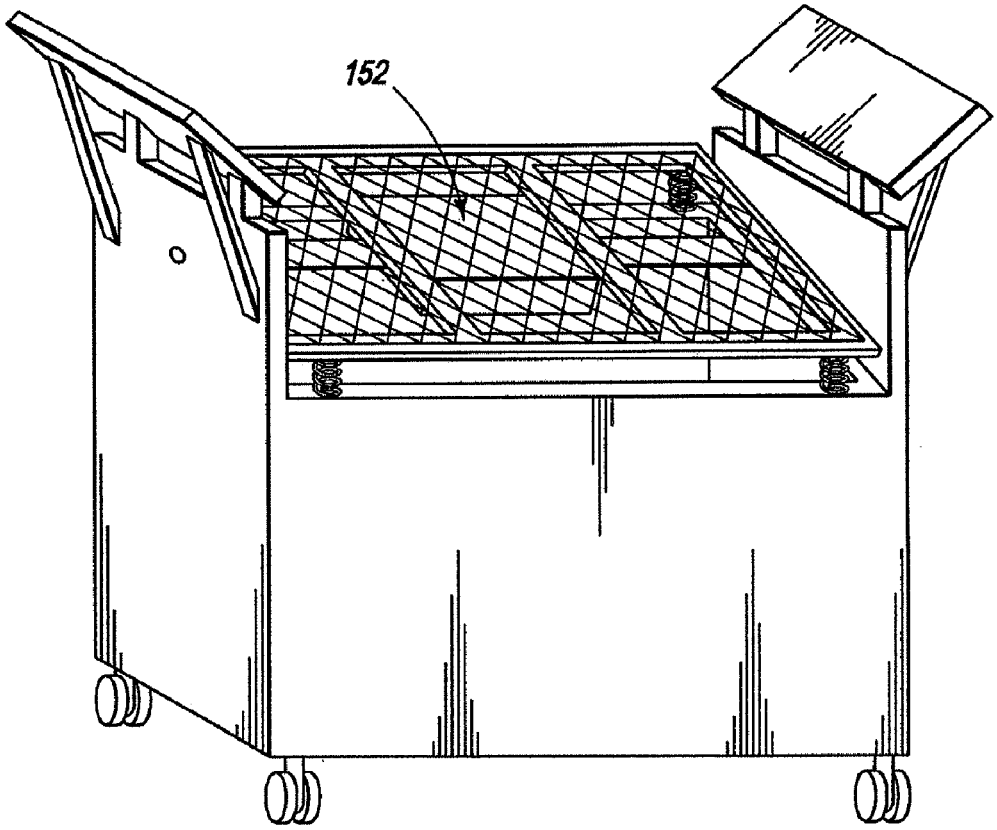
FIG. 1B illustrates the front view of an alternate embodiment of the vibrating screen aggregate separator of FIG. 1A.

Turning to FIG. 1B, an alternate embodiment of vibrating screen aggregate separator 100 is exemplified, whereby support structure 152 is incorporated. In particular, support structure 152 may exist at, or about, the center point along the length of shaft 116, whereby shaft 116 may be rigidly coupled to each end of support structure 152. As discussed in more detail below, support structure 152 implements additional stability for shaft 116, as well as its contents, during vibration of screen 106.

Figure 1C:
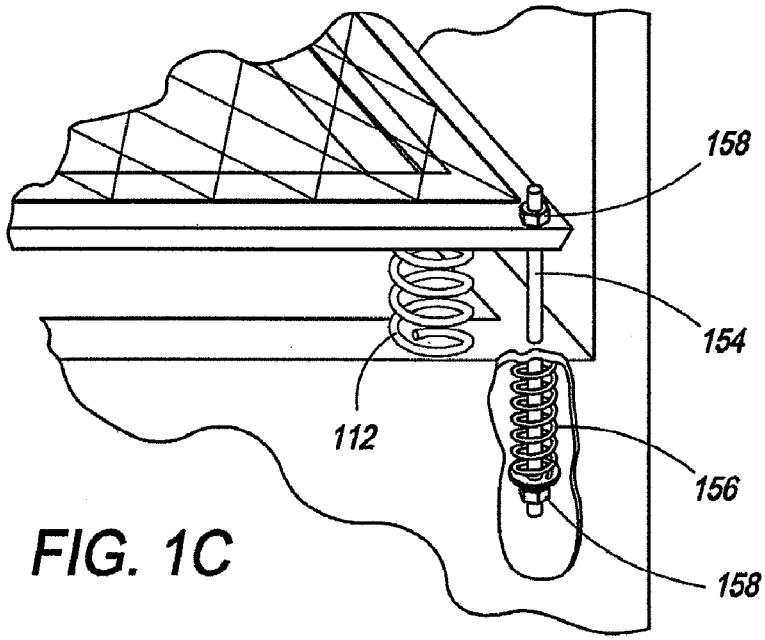
FIG. 1C illustrates an exploded view of a stop mechanism used by the vibrating screen aggregate separators of FIGS. 1A and 1B.

Turning to FIG. 1C, an exploded detail of a stop mechanism for the vibrating aggregate separators of FIGS. 1A and 1B is exemplified. Due to the non-rigidity of the coupling between screen 106 and container 102, under certain conditions, screen 106 may tend to pitch upward causing suspension system 112 to hyperextend, or in an extreme case, cause screen 106 to separate from container 102. Such a hyperextension may be caused, for example, by an uneven load of aggregate placed onto screen 106, or simply during the initiation or cessation of the vibration of screen 106.

In such instances, one or more rods 154 may be inserted through one or more corners of support structure 104 and corresponding corners of container 102 as illustrated. Retainer nuts 158, or other coupling means, may be secured at each end of rod 154 so as to maintain spring 156 at a positive compression force. In operation, any upward movement of screen 106 and support structure 104 may be opposed by the compression force of spring 156, such that any hyperextension of spring 112 is reduced by the compression force of spring 156 and eventual dead stop by retainer nuts 158.

Figure 2A:
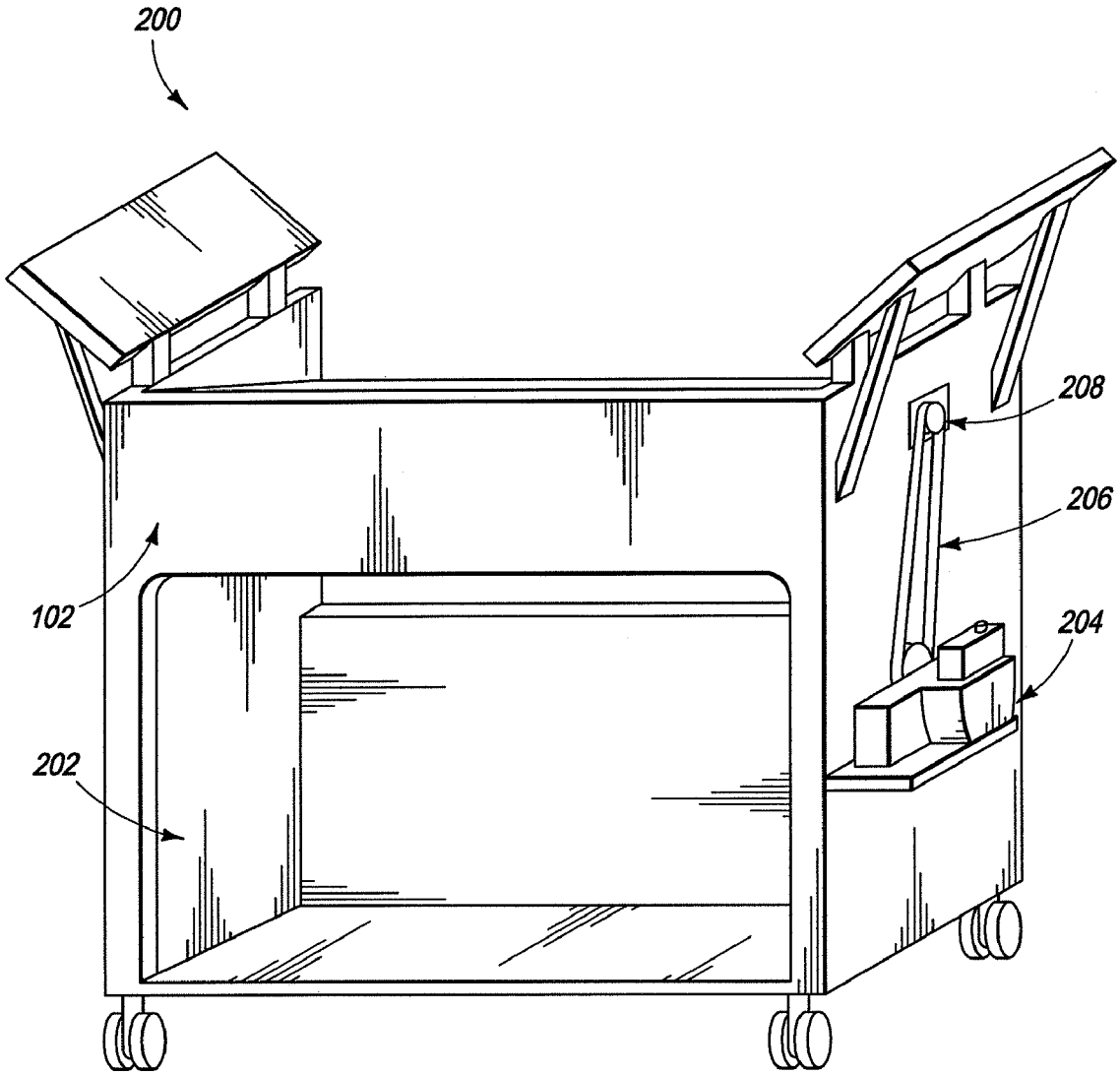
FIG. 2A illustrates a rear view of the vibrating screen aggregate separator of FIGS. 1A and 1B.

Turning to FIG. 2A, the back side of vibrating screen aggregate separator 200 is exemplified, whereby opening 202 is provided within container 102. In particular, as the screened material falls into container 102 during operation, it collects into a pile of desired material within container 102 that is accessible via opening 202. As such, the bucket of a front loader, bucket loader, or other material moving device, having a bucket width that is narrower than opening 202 may be easily inserted into opening 202.

Thus, the pile of desired material may be extracted from container 202 by inserting the bucket into opening 202, scooping the desired material into the bucket, and transporting the desired material to various locations within the construction site that are in need of screened aggregate. Such locations may include plumbing, sewage, and utility trenches, as well as any other excavations, that are in need of screened backfill.

As discussed in more detail below, vibrating screen aggregate separator 200 may include a mechanical energy source, such as an electrical motor or combustion engine 204. Motor 204 may transfer rotational energy to pulley 208 via a non-rigid energy transfer mechanism, such as belt or chain 206.

Pulley 208 may in turn be coupled to an unbalanced rod (not shown), which is rotated by the rotational energy transferred to pulley 208, which in turn causes vibration during operation of vibrating screen aggregate separator 200.

Figure 2B:
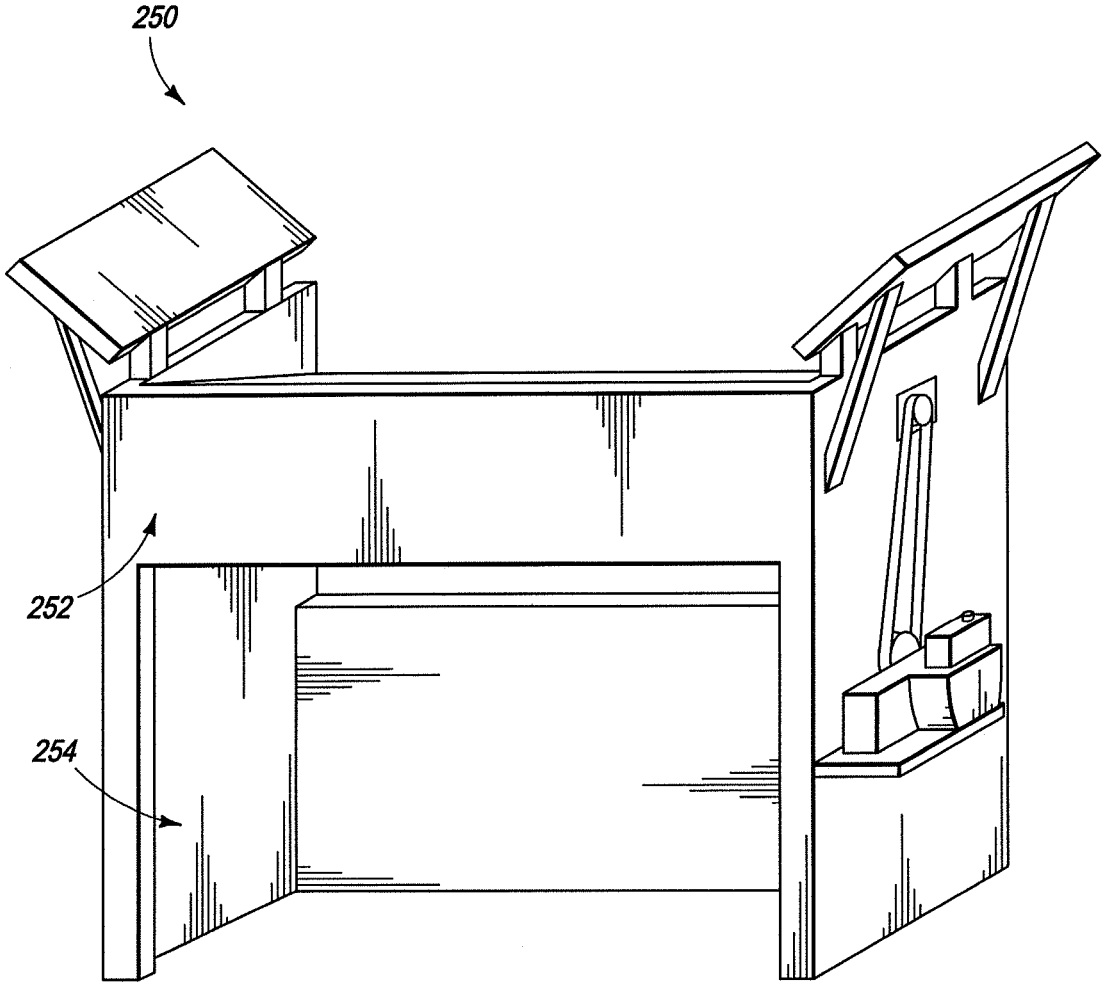
FIG. 2B illustrates a rear view of an alternate vibrating screen aggregate separator.

Turning to FIG. 2B, the back side of an alternate vibrating screen aggregate separator 250 is exemplified, whereby an alternately shaped opening 254 is provided within container 252. In particular, opening 254 is squared off at the corners in order to provide the largest opening possible to facilitate retrieval of the desired material from container 252. In addition, the floor of container 252 is removed to further facilitate retrieval of the desired material from container 252 by providing maximum vertical clearance of opening 254. Further, casters have been removed from vibrating screen aggregate separator 250, whereby an alternate means of mobility is implemented as discussed in more detail below.

Figure 3A:
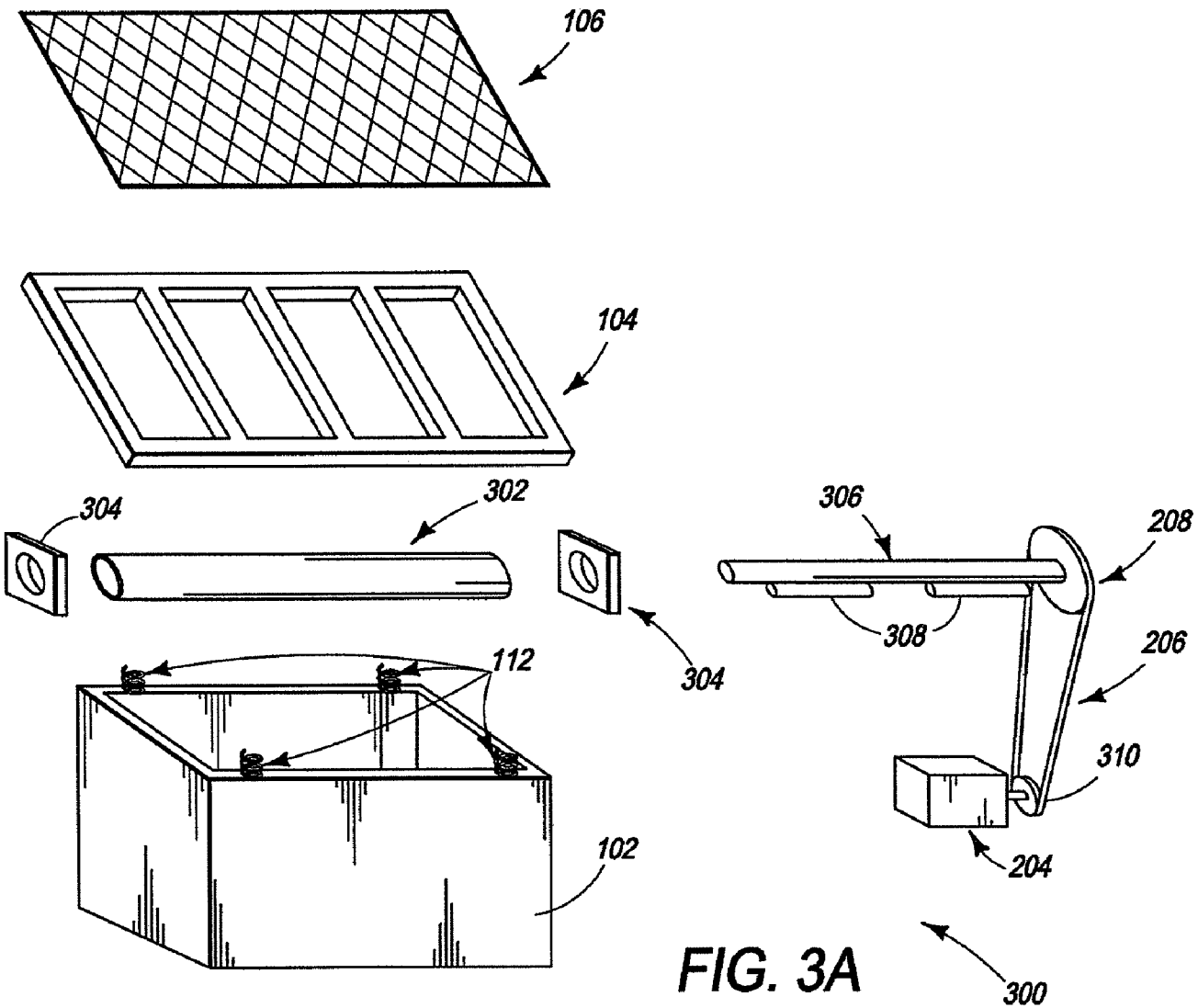
FIG. 3A illustrates an expanded view of the vibrating screen aggregate separator of FIG. 1A.

Turning to FIG. 3A, an expanded view of vibrating screen aggregate separator 300 is exemplified. Screen 106 and support structure 104 may be coupled together in a rigid manner, e.g., via welded or bolted connections. The screen 106/support structure 104 composite assembly may, or may not, be coupled to suspension system 112 in a rigid manner. In such an instance, the screen 106/support structure 104 composite assembly "floats" above container 102, whereby the distance between the screen 106/support structure 104 composite assembly and container 102 is maintained within a distance range. The distance range is conducive to allow a full load of pre-screened aggregate to be placed on top of the screen 106/support structure 104 composite assembly, while at the same time facilitating screening of the aggregate material via oscillatory deflections that are applied to the screen 106/support structure 104 composite assembly.

Oscillatory deflections may be imparted to the screen 106/support structure 104 composite assembly via rotation of unbalanced rod 306 along its longitudinal axis. In particular, the rod's mass at each end of the rod is made to be greater than the rod's mass at its center, by the addition of weight offsets 308. In one embodiment, weight offsets 308 may be comprised of the same material as unbalanced rod 306. As such, shorter sections of rod material may be welded, clamped, bolted, or otherwise coupled to unbalanced rod 306 to provide weight offsets 308.

As unbalanced rod 306 is rotated along its longitudinal axis, the angular momentum at each end of unbalanced rod 306 is greater than the angular momentum at the center of unbalanced rod 306. Thus, the moment of inertia generated at each end of unbalanced rod 306 is greater than the moment of inertia at the center of unbalanced rod 306. The difference in moments of inertia imparts a vibrational oscillation to the screen 106/support structure 104 composite assembly, whose fundamental frequency is inversely proportional to the amount of time required to rotate unbalanced rod 306 through a 360 degree cycle.

In order to facilitate the transfer of vibrational energy, unbalanced rod 306 may be displaced within hollow shaft 302, where hollow shaft 302 may be coupled to the screen 106/support structure 104 composite assembly. At each end of hollow shaft 302, supporting structures, such as pillow block bearings 304, may be attached. Unbalanced rod 306 may then be secured to each pillow block bearing 304 to provide load support during the rotation of unbalanced rod 306 within hollow shaft 302.

The rotation of unbalanced rod 306 may be effected by applying a rotational force at either end of unbalanced rod 306. In one embodiment, pulley 208 may be attached to one end of unbalanced rod 306, which may then be coupled to a mechanical energy source, such as an electrical motor, or combustion engine 204. Motor 204, having its own rotating shaft and pulley 310, may then impart rotational energy to unbalanced rod 306 via belt or chain 206. In particular, pulley 310 may be non-rigidly coupled, via belt or chain 206, to pulley 208 in order to allow mechanical energy to be transferred from motor 204 to unbalanced rod 306.

As such, the shaft of motor 204 may rotate substantially vibration free, while at the same time imparting rotational energy to unbalanced rod 306, which in turn causes oscillatory deflections of unbalanced rod 306 that are orthogonal to its longitudinal axis of rotation. As unbalanced rod 306 oscillates, variations in the tension of belt or chain 206 may also occur. However, due to the non-rigidity of belt or chain 206 that couples each pulley, oscillatory deflections of unbalanced rod 306 do not cause damage to the motor, since any potentially damaging deflections are substantially absorbed by the interaction of belt or chain 306 with pulleys 208 and 310.

Oscillatory deflections of unbalanced rod 306 further cause vibrational energy to be transferred to the screen 106/support structure 104 composite assembly via hollow shaft 302 and the supporting structures of hollow shaft 302. As vibrational energy is transferred to the screen 106/support structure 104 composite assembly, pre-screened aggregate previously placed onto screen 106 is caused to either fall into container 102 as desired material, or to slide off of screen 106 as undesired material. The desired material may then be collected via openings 202 and 254 as discussed above in relation to FIGS. 2A and 2B.

Figure 3B:
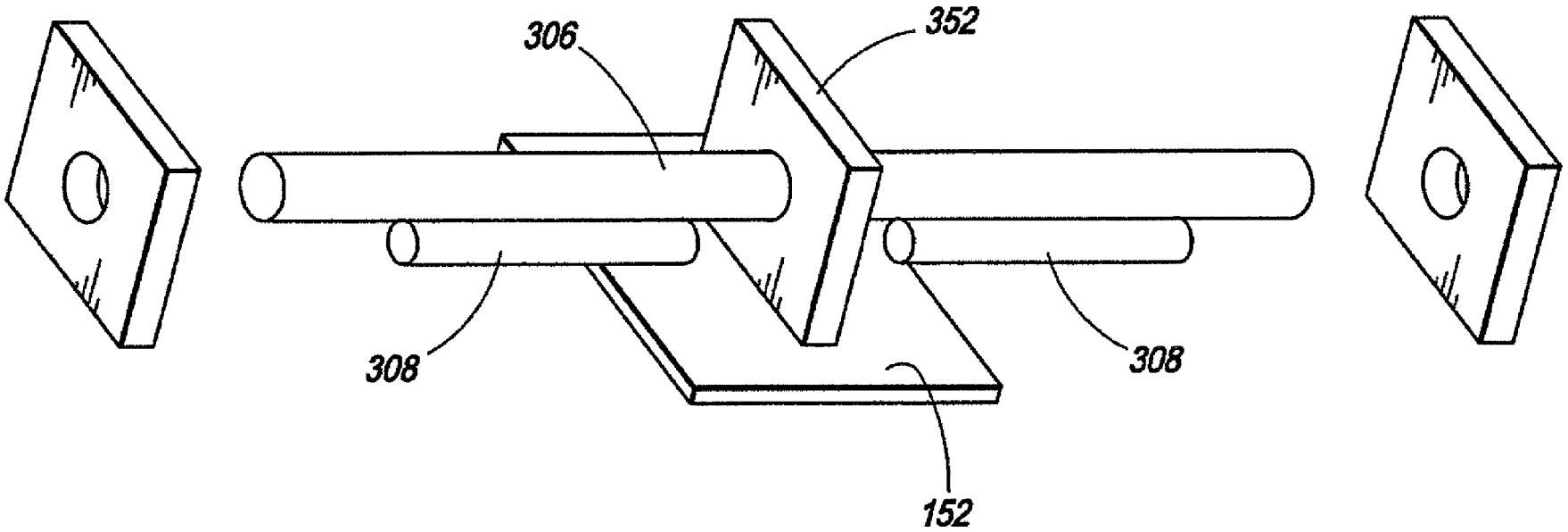
FIG. 3B illustrates an alternate expanded view of the vibrating screen aggregate separator of FIG. 1B.

Turning to FIG. 3B, an alternate embodiment of vibrating screen aggregate separator 300 is exemplified, whereby in order to add further stability to unbalanced rod 306 during rotation, supporting structure 352 may be added. In particular, while the unbalanced rod is secured at each end by, for example, pillow block bearings 304, an additional pillow block bearing 352 may be added at, or near, the center point of unbalanced rod 306. As such, positioning of unbalanced rod 306 through all rotation cycles may be controlled so as to avoid excessive deflections of unbalanced rod 306 that are orthogonal to its longitudinal axis. Such deflections may be caused, for example, by the elasticity of the material used for the unbalanced rod, whereby excessive forces imposed on the unbalanced rod cause it to bend, or strain, under stress.

Support structure 152 may also be added at, or near, the mid-point of hollow shaft 302 (not shown in FIG. 3B). In such an instance, hollow shaft 302 may be rigidly coupled to either side of support structure 152 without passing through the interior of support structure 152 as discussed above in relation to FIG. 1B. Unbalanced rod 306 rotates within the interior of support structure 152 while being further supported by pillow block bearing 352 during rotation. As such, excessive deflections of unbalanced rod 306 are substantially eliminated by pillow block bearing 352 to prevent undue stress or strain on unbalanced rod 306 during rotation.

In other embodiments, the necessity of a center-mounted support structure for unbalanced rod 306 may be obviated by increasing the rigidity of unbalanced rod 306, thereby decreasing its elasticity. Such increases in rigidity may be accomplished, for example, through selection of more rigid materials, or conversely, through a design of the unbalanced rod that is resistant to stress induced deformation. For example, ribs may be disposed along the longitudinal axis of unbalanced rod 306 in order to provide additional stiffness.

Figure 4A:
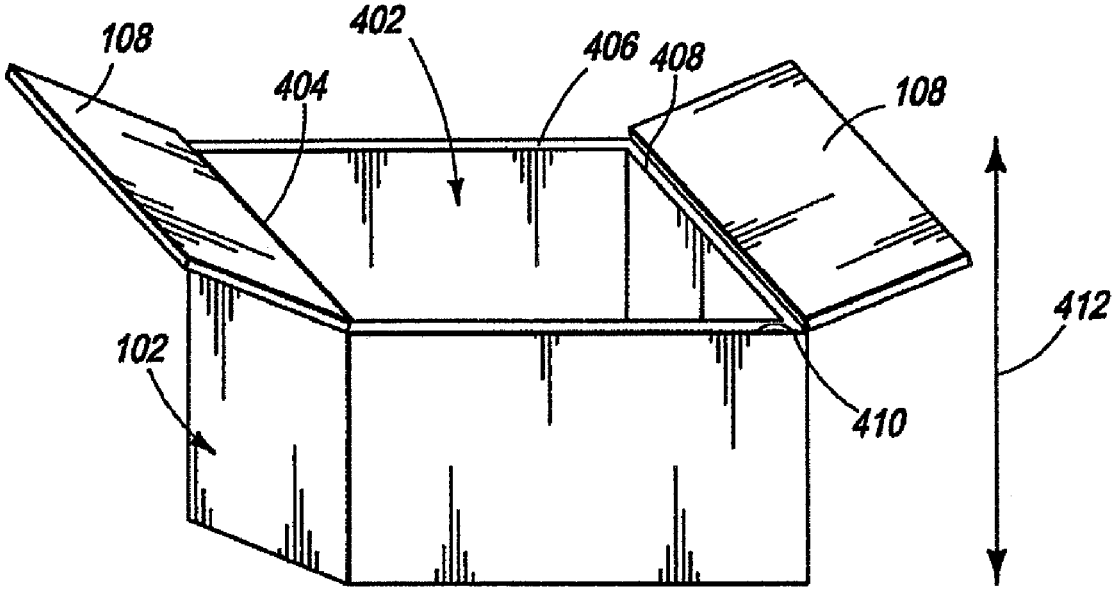
FIG. 4A illustrates exemplary details of a container of the vibrating screen aggregate separator of FIGS. 1A and 1B.

Turning to FIG. 4A, other details of container 102 are exemplified. In particular, as discussed above, container 102 may provide a downward slope from one end of container 102 to the other, whereby top edge 406 is higher than bottom edge 410 with respect to vertical axis 412. Such a slope allows aggregate material to more easily roll/slide off of vibrating screen 106 of FIGS. 1A-1C during the aggregate separation operation.

In one embodiment, container 102 is comprised of four walls that extend along vertical axis 412, where the four walls provide top edges 404-410. Thus, top edges 404-410 combine to form the structural support for suspension system 112, as well as the support for the screen 106/support structure 104 composite assembly of FIGS. 1A-1C.

Ingress of the desired material into container 102 during aggregate separation is facilitated by opening 402, which provides the outlet that is required by the screen 106/support structure 104 composite assembly of FIGS. 1A-1C. In particular, opening 402 allows screened material to fall into container 102 during aggregate separation. Egress of the desired material is further facilitated by opening 416 as exemplified in FIG. 4B. In one embodiment, for example, opening 416 may exist at back side 414 of container 102, whereby back side 414 also forms top edge 406. Other embodiments may instead provide egress of the desired material either from an opening that exists at the front side of container 102, or from openings that exist at the left and/or right side of container 102.

Figure 5:
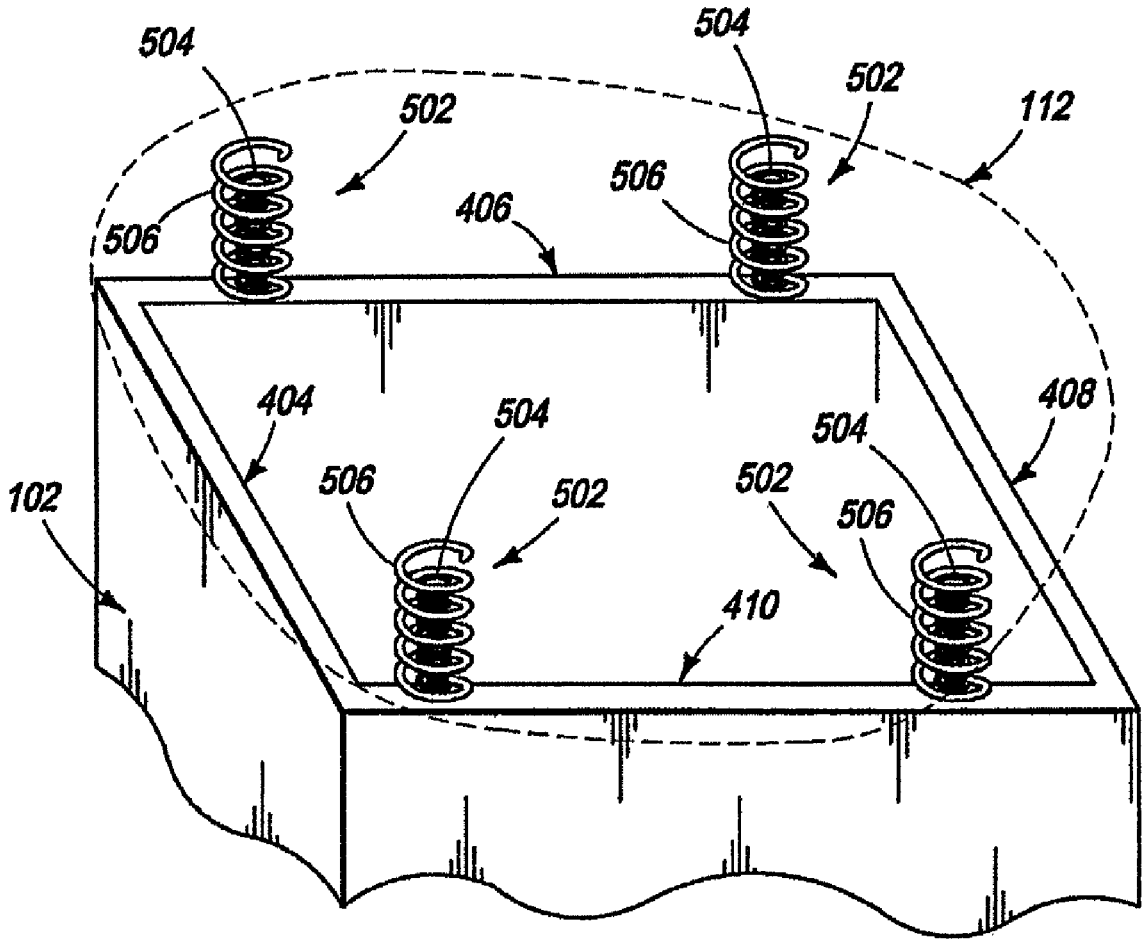
FIG. 5 illustrates an exemplary suspension system of the vibrating screen aggregate separator of FIGS. 1A and 1B.

Turning to FIG. 5, suspension system 112, as discussed above in relation to FIGS. 1A-1C, is exemplified in greater detail. Suspension system 112 may be comprised of a plurality of coiled spring assemblies 502 having a plurality of spring constants k1, k2, . . . , kn, and associated range of physical dimensions. As illustrated, springs 506 are shown to have a larger diameter than springs 504, such that springs 504 may have a larger spring constant as compared to the spring constant of springs 506.

Any number of spring assemblies may be attached to top edges 404-410, whereby in one embodiment, two spring assemblies 502 may be coupled to top edge 406 and two spring assemblies 502 may be coupled to bottom edge 410. Spring assemblies 502 may also be coupled to top edges 404 and 408 as required. While spring assemblies 502 are shown to be comprised of inner spring 504 and outer spring 506, other configurations (not shown) may be provided such that springs 504 and 506 may exist independently of one another.

In operation, spring assemblies 502 are engaged to maintain the vibrating screen and associated support structure (not shown) at a minimum separation distance from container 102, so as to allow full scale deflection of the vibrating screen and associated support structure during all vibration cycles. For example, once the initial load of pre-screened material is deposited onto the vibrating screen and associated support structure, the amount of compression force exerted by suspension system 112 is maximized, such that springs 504 and 506 combine to support the weight of the pre-screened material, as well as the vibrating screen and associated support structure.

As the pre-screened material begins to either drop into container 102, or is rejected by the vibrating screen, the amount of compression force that is exerted by suspension system 112 reduces due to the decreasing weight of the pre-screened material. In particular, springs 504 may be allowed to reach their uncompressed height once the pre-screened material has reached a threshold weight, whereas springs 506 remain compressed to the extent necessary to support the weight of the remaining pre-screened material, as well as the vibrating screen and associated support structure. As such, during the course of aggregate separation of a single load of material, a distance is maintained within a range of distance, such that the vibrating screen and associated support structure are precluded from making contact with container 102 during each vibration cycle.

Figure 6:
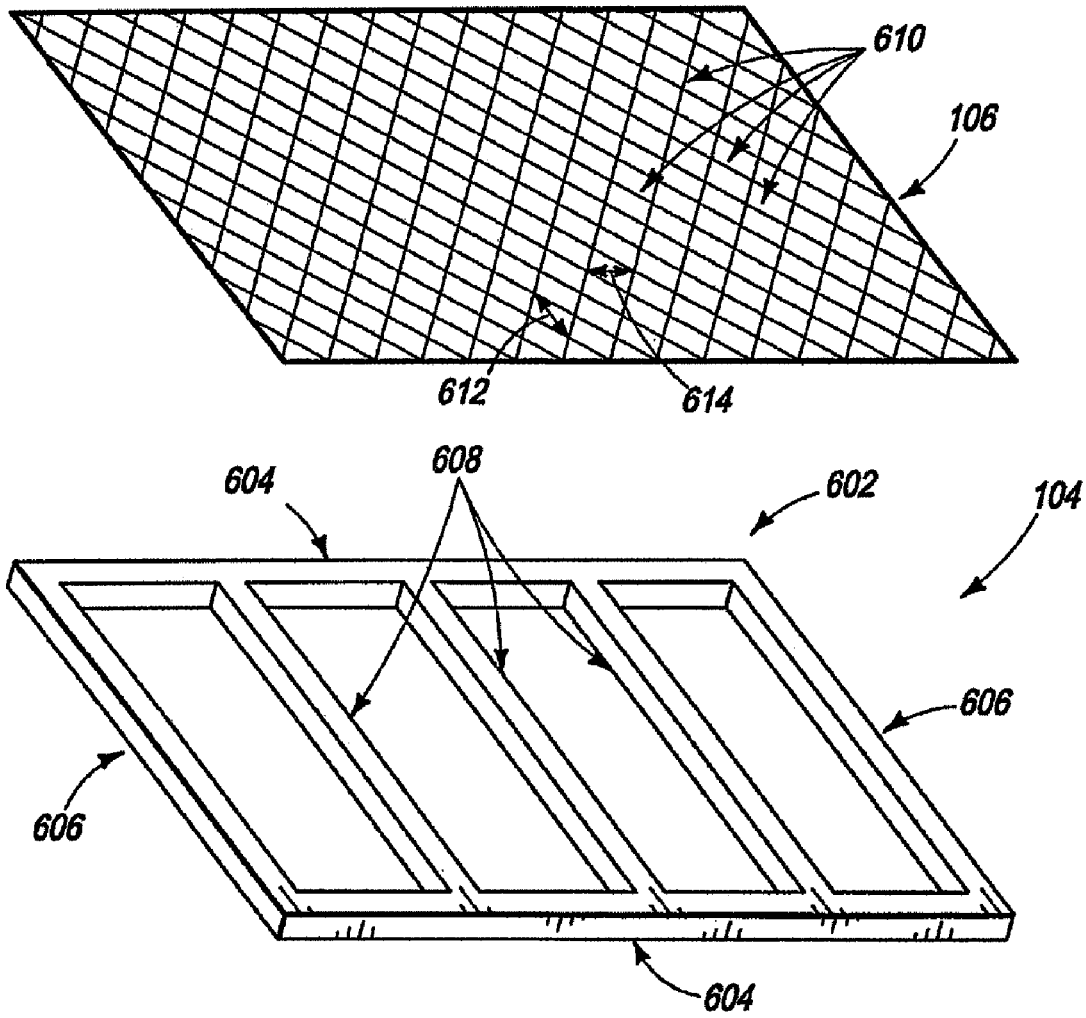
FIG. 6 illustrates an exemplary diagram of the screen/support structure composite assembly of the vibrating screen aggregate separator of FIGS. 1A and 1B.

Turning to FIG. 6, an exemplary diagram of the screen 106/support structure 104 composite assembly of FIGS. 1A-1C is illustrated. Support structure 104 may assume virtually any shape, but is illustrated as a substantially rectangular structure. Longitudinal beams 604 are sized such that they coincide with top edges 406 and 410 of container 102 as illustrated in FIGS. 4 and 5. Similarly, beams 606 are configured to be substantially perpendicular to beams 604 and are sized such that they coincide with side edges 404 and 408 of container 102. Other beams 608 may be added to support structure 104 at varying angles with respect to beams 604 and 606 as may be necessary for added support.

Screen 106 and support structure 104 may be coupled together in a rigid manner, e.g., via welded or bolted connections, to form a composite assembly. The composite assembly may then "float" above container 102 of FIGS. 1A-1C, whereby the distance between the screen 106/support structure 104 composite assembly and container 102 is maintained within a distance range by suspension system 112 as discussed above in relation to FIGS. 1A-1C, 3, and 5.

The dimensions of mesh perforations 612 and 614 of screen 106 may be selected to be equal to the maximum grain size that is allowed to be collected as desired material within container 102. In particular, any particle of pre-screened aggregate having dimensions smaller than those defined by mesh perforations 612 and 614 are allowed passage into container 102 during aggregate separation. Any particle of pre-screened aggregate having dimensions larger than those defined by mesh perforations 612 and 614, on the other hand, are disallowed passage into container 102 and are thus required to roll/slide off of screen 106 to form the separated undesired material pile located outside of container 102.

Figure 7A:
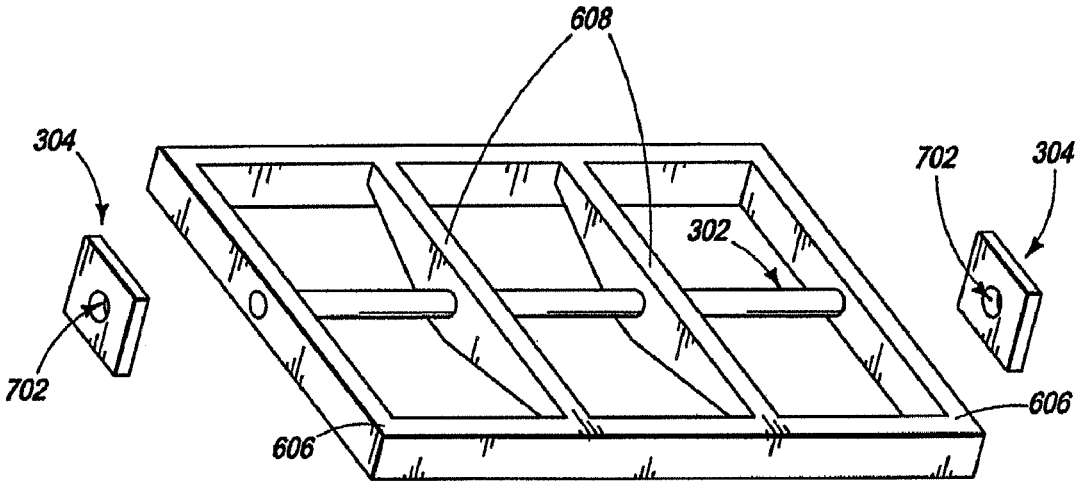
FIG. 7A illustrates exemplary details of a support structure of the vibrating screen aggregate separator of FIG. 1A.

Turning to FIGS. 7A through 7D, alternate embodiments of support structure 104 are illustrated. In FIG. 7A, for example, support beams 606 and 608 are bored at approximately their center points to allow insertion of hollow shaft 302. Once inserted, hollow shaft 302 may be clamped, welded, bolted, or otherwise rigidly coupled to beams 606 and 608. At each end of hollow shaft 302, supporting structures, such as pillow block bearings 304, may be attached as discussed above in relation to FIG. 3A. The unbalanced rod (not shown) may then be secured to each pillow block bearing 304 at coupling positions 702 in order to provide load support during the rotation of the unbalanced rod within hollow shaft 302 during aggregate separation.

Figure 7B:
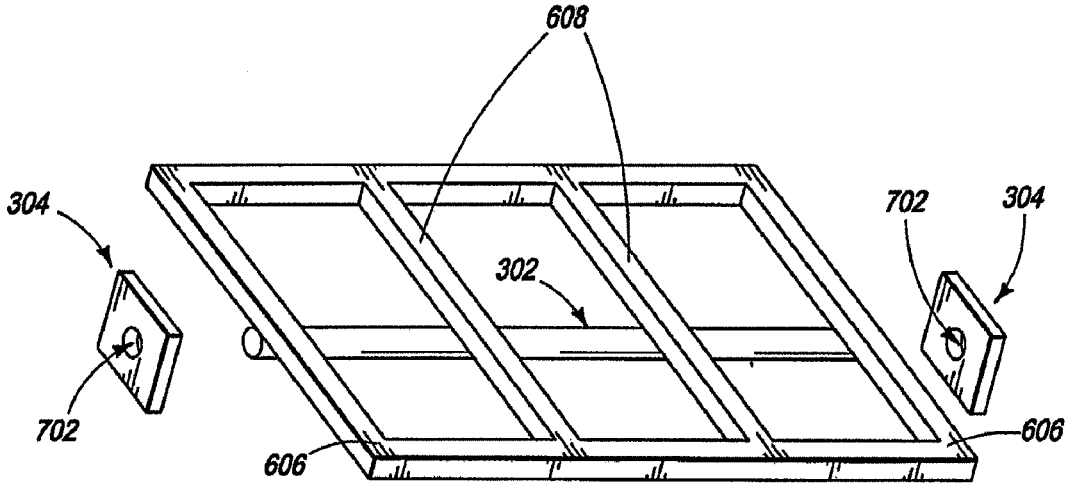
FIG. 7B illustrates alternate details of a support structure of the vibrating screen aggregate separator of FIG. 1A.
Figure 7C:
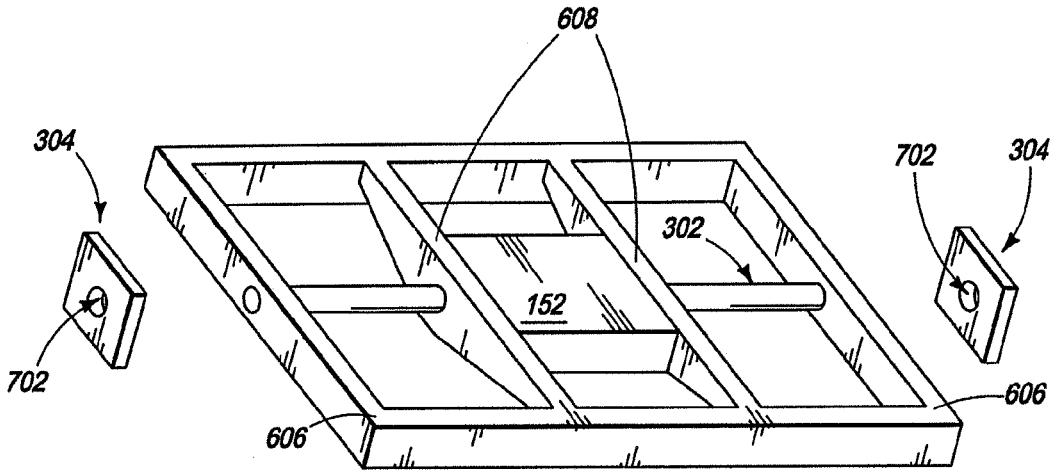
FIG. 7C illustrates exemplary details of a support structure of the vibrating screen aggregate separator of FIG. 1B.

In FIG. 7C, for example, support beams 606 and 608 are bored at approximately their center points to allow insertion of hollow shaft 302. Support structure 152 may also be displaced between support beams 608. Once inserted, hollow shaft 302 may be clamped, welded, bolted, or otherwise rigidly coupled to beams 606 and 608 and to each side of support structure 152 as illustrated. At each end of hollow shaft 302, supporting structures, such as pillow block bearings 304, may be attached as discussed above in relation to FIG. 3B. In addition, pillow block bearing 352 (not shown) may be mounted to the interior of support structure 152 as discussed above in relation to FIG. 3B. The unbalanced rod (not shown) may then be secured to each pillow block bearing 304 at coupling positions 702, as well as to pillow block bearing 352, in order to provide load support during the rotation of the unbalanced rod within hollow shaft 302 during aggregate separation.

Turning to FIG. 7B, support beams 606 and 608 are not bored, but are instead left intact. As such, hollow shaft 302 may be coupled to the underside of beams 606 and 608 via one or more of a clamped, welded, bolted, or other rigid coupling means. At each end of hollow shaft 302, supporting structures, such as pillow block bearings 304, may be attached as discussed above in relation to FIG. 3A. The unbalanced rod (not shown) may then be secured to each pillow block bearing 304 at coupling positions 702 in order to provide load support during the rotation of the unbalanced rod within hollow shaft 302 during aggregate separation.

Figure 7D:
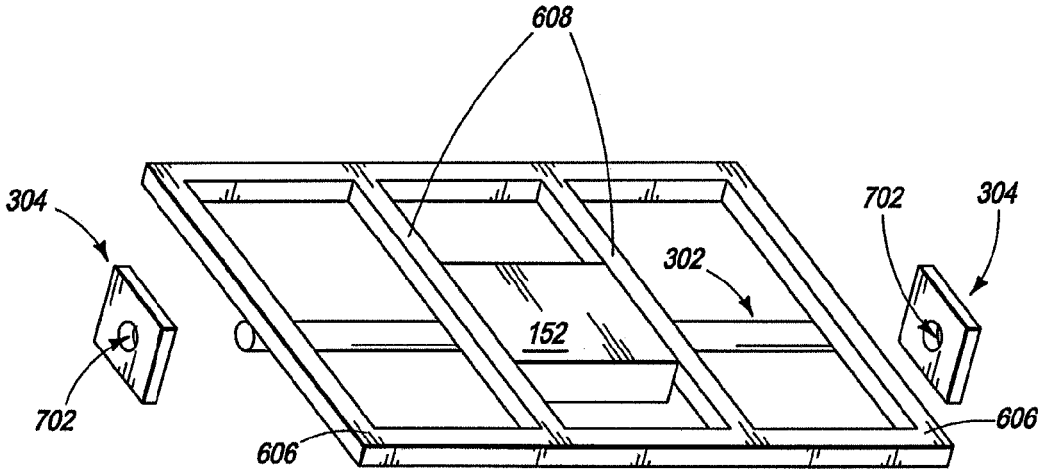
FIG. 7D illustrates alternate details of a support structure of the vibrating screen aggregate separator of FIG. 1B.

Turning to FIG. 7D, support beams 606 and 608 are not bored, but are instead left intact. As such, hollow shaft 302 may be coupled to the underside of beams 606 and 608 and to each side of support structure 152 via one or more of a clamped, welded, bolted, or other rigid coupling means. At each end of hollow shaft 302, supporting structures, such as pillow block bearings 304, may be attached as discussed above in relation to FIG. 3B. Pillow block bearing 352 (not shown) may also be displaced within the interior of support structure 152. The unbalanced rod may then be secured to each pillow block bearing 304 at coupling positions 702, as well as to pillow block bearing 352 (not shown), in order to provide load support during the rotation of the unbalanced rod within hollow shaft 302 during aggregate separation.

As discussed above, aggregate separation can be useful anytime materials are excavated and then reused. In one application, vibrating screen aggregate separator 808 of FIG. 8 may be transported to a construction site via truck 802 and/or towable trailer 806. In the illustrated embodiment, vibrating screen aggregate separator 808 is not configured with casters and is instead located to a position within the construction site through the use of tractor 804.

Figure 4B:
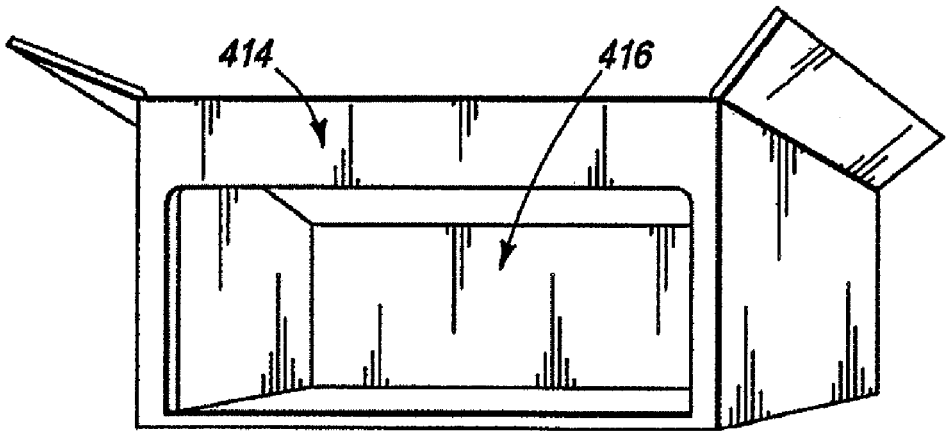
FIG. 4B illustrates alternate details of an exemplary container of the vibrating screen aggregate separator of FIGS. 1A and 1B.
Figure 8:
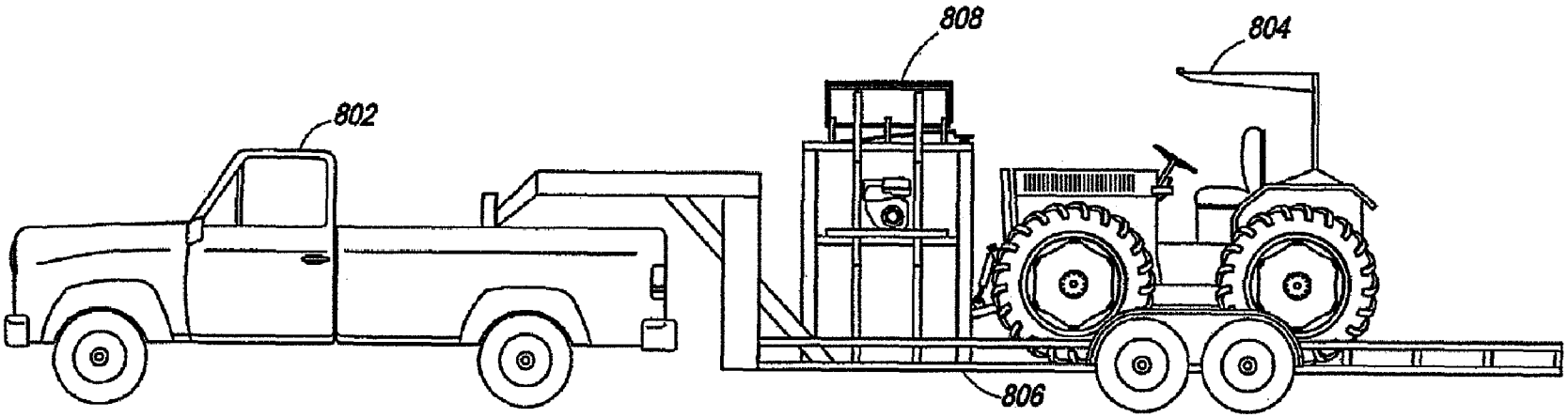
FIG. 8 illustrates a transportable configuration of the vibrating screen aggregate separator of FIG. 1.

In such an instance, vibrating screen aggregate separator 808 may be lifted off of trailer 806 by inserting the bucket of tractor 804 into openings 202, 254, and 416 as illustrated in FIGS. 2A, 2B, and 4B, respectively. In particular, once the bucket of tractor 804 is inserted into opening 202, as illustrated in FIG. 8, vibrating screen aggregate separator 808 may be lifted off of trailer 806. Vibrating screen aggregate separator 808 may then be located anywhere within the construction site by: backing tractor 804 off of trailer 806; relocating vibrating screen aggregate separator 808 to the desired location; and lowering the bucket of tractor 804 at the desired location.

Figure 9:
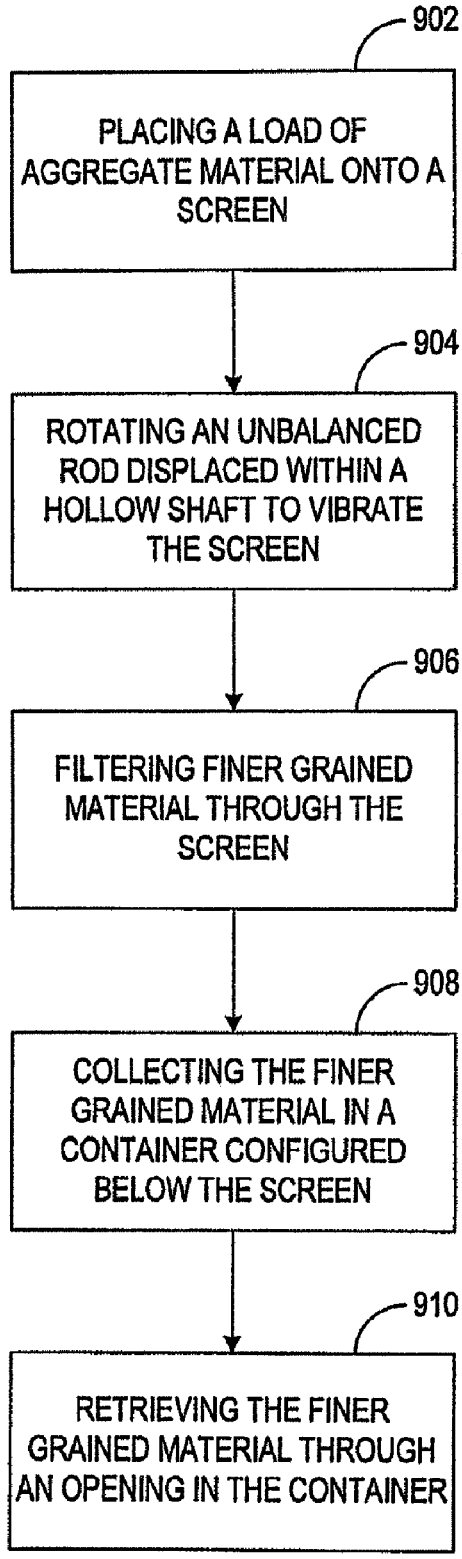
FIG. 9 illustrates a flow diagram of a method of operating a vibrating screen aggregate separator.

Turning to FIG. 9, a method of operating vibrating screen aggregate separator 808 is exemplified. It is noted that steps 902 and 904 may be interchanged with one another, since rotation of unbalanced rod 306 to cause vibration of screen 106 may be commenced prior to placing a load of aggregate material onto screen 106. Once at the desired location, motor 204 of FIGS. 2A, 2B, and 3A may be started, which causes rotation of unbalanced rod 306 of FIGS. 3A-3B as in step 904. Rotation of unbalanced rod 306 then transfers vibrational energy to screen 106 and supporting structure 104 as discussed above. Any aggregate material placed onto screen 106, via step 902, is then filtered into desired material as in step 906, which falls into container 102 of FIGS. 1A-1C, 2A, 2B, 3A, 4A-4B, and 5 for collection as in step 908. Any undesired material rolls or slides off of screen 106 to be safely separated from the desired material within container 102.

In operation, therefore, tractor 804 may collect all material that has been excavated from plumbing, sewage, and utility trenches, as well as any other excavations that may have been necessary at the construction site. The collected material may then be transported to vibrating screen aggregate separator 808 via tractor 804 and deposited onto vibrating screen 106, whereby any spillage is minimized by guiding panels 108. Those trenches requiring backfill of a finer composition may then be filled with the desired material that is generated by vibrating screen aggregate separator 808. In particular, tractor 806 may collect the desired material from within container 102, via openings 202, 254, and 416 as in step 910, and may relocate the desired material to those trenches requiring a finer composition backfill.

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. An aggregate separation device, comprising:

a container;

a suspension system coupled to the container;

a screen coupled to the suspension system, the screen configured with a plurality of perforations having a first diameter;

a hollow shaft coupled to the screen, the hollow shaft having first and second ends;

a first support structure coupled to a center portion of the hollow shaft, wherein the first and second ends of the hollow shaft are coupled to first and second sides of the first support structure;

an unbalanced rod displaced within the hollow shaft, the unbalanced rod being supported on each end of the unbalanced rod by first and second support bearings;

a mechanical energy source coupled to the unbalanced rod and adapted to rotate the unbalanced rod to transfer vibrational energy to the screen via the hollow shaft; and a third support bearing coupled to a center portion of the unbalanced rod to prevent excessive deflection of the unbalanced rod during rotation, wherein the third support bearing is enclosed within the first support structure outside of the hollow shaft.

2. The aggregate separation device of claim 1, wherein the container comprises:

a plurality of walls extending along a first axis, each of the plurality of walls being coupled together to form an enclosure having first and second openings;

wherein the first opening is configured to receive filtered material deposited at a first end of the enclosure; and wherein a second opening is configured to allow extraction of the filtered material from a second end of the enclosure.

3. The aggregate separation device of claim 2, wherein a length along the first axis of a back wall of the plurality of walls is greater than a length along the first axis of a front wall of the plurality of walls.

4. The aggregate separation device of claim 3, wherein the suspension system comprises:

a first plurality of springs coupled to top edges of the front and back walls; and a second plurality of springs coupled to top edges of the front and back walls, wherein the first plurality of springs has a greater spring constant relative to a spring constant of the second plurality of springs.

5. The aggregate separation device of claim 4, wherein each of the first plurality of springs is displaced within a circumference defined by each respective spring of the second plurality of springs.

6. The aggregate separation device of claim 5, further comprising:

a second support structure coupled between the screen and the suspension system, the second support structure including a plurality of support members wherein the screen is mounted to a first surface of the support members; and a stop mechanism displaced through the second support structure and the container to oppose movement of the screen in a first direction along the first axis.

7. The aggregate separation device of claim 6, wherein the hollow shaft is coupled to a second surface of the support members.

8. The aggregate separation device of claim 6, wherein the hollow shaft is displaced within the support members of the second support structure.

9. The aggregate separation device of claim 1, wherein the unbalanced rod comprises:

a first rod having a length;

a first weight offset coupled along the length of the first rod at a first end; and a second weight offset coupled along the length of the first rod at a second end.

10. The aggregate separation device of claim 1, wherein the mechanical energy source comprises:

a shaft;

a first pulley coupled to the shaft; and an engine coupled to the shaft and adapted to rotate the shaft and the first pulley.

11. The aggregate separation device of claim 10 further comprising:

a second pulley coupled to the unbalanced rod; and a belt non-rigidly coupled between the first and second pulleys, the belt adapted to impart rotational energy to the unbalanced rod upon rotation of the mechanical energy source's shaft.

12. A method of separating desired material from an aggregate material, the method comprising:

placing a quantity of aggregate material onto a screen, the screen configured with a plurality of perforations having a first diameter;

displacing an unbalanced rod within a hollow shaft;

supporting the unbalanced rod at first and second ends of the unbalanced rod;

rotating the unbalanced rod within the hollow shaft to transfer vibrational energy to the screen;

supporting the unbalanced rod between the first and second ends at a midpoint along a length of the unbalanced rod to eliminate excessive deflections of the unbalanced rod during rotation;

coupling a support structure to the hollow shaft, wherein supporting the unbalanced rod at the midpoint of the unbalanced rod occurs within the support structure outside of the hollow shaft; and filtering desired material from the aggregate material through the screen in response to the vibrational energy transfer, wherein the desired material is composed of granules having a diameter less than the first diameter.

13. The method of claim 12, wherein rotating the unbalanced rod comprises:

rotating the shaft of a mechanical energy source; and non-rigidly coupling the rotating shaft to the unbalanced rod, wherein the non-rigid coupling substantially absorbs the vibrational energy to prevent damage to the mechanical energy source.

14. An aggregate separation device, comprising:

a container having first and second openings;

a suspension system coupled to the container;

a screen coupled to the suspension system and displaced over the first opening, the screen configured with a plurality of perforations having a first diameter;

a hollow shaft coupled to the screen, the hollow shaft including an unbalanced rod displaced within the hollow shaft, the unbalanced rod being supported on first and second ends of the unbalanced rod by first and second support bearings;

a first support structure coupled to a center portion of the hollow shaft, wherein first and second ends of the hollow shaft are coupled to first and second sides of the first support structure;

a mechanical energy source coupled to the unbalanced rod and adapted to rotate the unbalanced rod to vibrate the screen;

a third support bearing coupled to a center portion of the unbalanced rod to prevent excessive deflection of the unbalanced rod during rotation, the third support bearing being enclosed within the first support structure outside of the hollow shaft; and wherein aggregate material placed on the screen is filtered into granules having a diameter less than the first diameter by the vibrating screen, the granules being accessible within the container via the second opening.

15. The aggregate separation device of claim 14, wherein the suspension system comprises:

a first plurality of springs coupled to top edges of front and back walls of the container; and a second plurality of springs coupled to top edges of the front and back walls, wherein the first plurality of springs has a greater spring constant relative to the spring constant of the second plurality of springs.

16. The aggregate separation device of claim 15, wherein each of the first plurality of springs is displaced within a circumference defined by each respective spring of the second plurality of springs.

17. The aggregate separation device of claim 14, further comprising a second support structure coupled between the screen and the suspension system, the second support structure including a plurality of support members wherein the screen is mounted to a first surface of the support members and the hollow shaft is displaced within the support members of the second support structure.

18. The aggregate separation device of claim 14, wherein the unbalanced rod comprises:

a first rod having a length;

a first weight offset coupled along the length of the first rod at a first end; and a second weight offset coupled along the length of the first rod at a second end.

19. The aggregate separation device of claim 18, wherein the mechanical energy source comprises:

a shaft;

a first pulley coupled to the shaft; and a motor coupled to the shaft and adapted to rotate the shaft and the first pulley.

20. The aggregate separation device of claim 19 further comprising:

a second pulley coupled to the unbalanced rod; and a belt non-rigidly coupled between the first and second pulleys, the belt adapted to impart rotational energy to the unbalanced rod upon rotation of the mechanical energy source's shaft.

* * * * *